US008137119B2

(12) United States Patent
Stoner

(10) Patent No.: US 8,137,119 B2
(45) Date of Patent: Mar. 20, 2012

(54) ELECTRICAL CONNECTOR SYSTEM HAVING A CONTINUOUS GROUND AT THE MATING INTERFACE THEREOF

(75) Inventor: Stuart C. Stoner, Lewisberry, PA (US)

(73) Assignee: FCI Americas Technology LLC, Carson City, NV (US)

( * ) Notice: Subject to any disclaimer, the term of this patent is extended or adjusted under 35 U.S.C. 154(b) by 0 days.

(21) Appl. No.: 12/833,322

(22) Filed: Jul. 9, 2010

(65) Prior Publication Data

US 2010/0273354 A1 Oct. 28, 2010

Related U.S. Application Data

(63) Continuation of application No. 12/129,086, filed on May 29, 2008, now Pat. No. 7,811,100.

(60) Provisional application No. 60/949,541, filed on Jul. 13, 2007.

(51) Int. Cl.
*H01R 4/66* (2006.01)

(52) U.S. Cl. ..... 439/108; 439/660; 439/181

(58) Field of Classification Search ..... 439/507, 439/512, 513, 516, 108, 660, 181, 65
See application file for complete search history.

(56) References Cited

U.S. PATENT DOCUMENTS

| | | | |
|---|---|---|---|
| 2,664,552 | A | 12/1953 | Ericsson et al. |
| 2,849,700 | A | 8/1958 | Perkin |
| 2,858,372 | A | 10/1958 | Kaufman |
| 3,115,379 | A | 12/1963 | McKee |
| 3,286,220 | A | 11/1966 | Marley |
| 3,343,120 | A | 9/1967 | Whiting |
| 3,399,372 | A | 8/1968 | Uberbacher |
| 3,538,486 | A | 11/1970 | Shlesinger, Jr. |
| 3,587,028 | A | 6/1971 | Uberbacher |
| 3,591,834 | A | 7/1971 | Kolias |
| 3,641,475 | A | 2/1972 | Irish et al. |
| 3,663,925 | A | 5/1972 | Proctor |
| 3,669,054 | A | 6/1972 | Desso et al. |
| 3,701,076 | A | 10/1972 | Irish |
| 3,748,633 | A | 7/1973 | Lundergan |

(Continued)

FOREIGN PATENT DOCUMENTS

| | | |
|---|---|---|
| EP | 0273683 | 7/1988 |

(Continued)

OTHER PUBLICATIONS

Author Unknown, "4.0 UHD Connector: Differential Signal Crosstalk, Reflections", 1998, 2 pages.

(Continued)

*Primary Examiner* — Tho D Ta
(74) *Attorney, Agent, or Firm* — Woodcock Washburn LLP

(57) ABSTRACT

A connector interface may include an arrangement of contacts in a first connector, and a corresponding, complementary arrangement of contacts in a second connector mating with the contacts of the first connector. The contacts may be signal contacts or ground contacts. When the connectors are mated, a ground may be established between the connectors by the mating of the ground contacts from the respective connectors. The ground contacts in the first connector may be shaped to bridge together an array of ground contacts in the second connector when the connectors are mated. Such bridging tends to establish a continuous ground along the array of ground contacts, creating a more robust ground than in an otherwise identical connector.

19 Claims, 6 Drawing Sheets

U.S. PATENT DOCUMENTS 3,827,005 A 7/1974 Friend
3,867,008 A 2/1975 Gartland, Jr.
4,030,792 A 6/1977 Fuerst
4,076,362 A 2/1978 Ichimura
4,084,872 A * 4/1978 Pritulsky ..... 439/513
4,157,612 A 6/1979 Rainal
4,159,861 A 7/1979 Anhalt
4,232,924 A 11/1980 Kline et al.
4,260,212 A 4/1981 Ritchie et al.
4,288,139 A 9/1981 Cobaugh et al.
4,383,724 A 5/1983 Verhoeven
4,402,563 A 9/1983 Sinclair
4,407,552 A 10/1983 Watanabe et al.
4,482,937 A 11/1984 Berg
4,487,464 A 12/1984 Kirschenbaum
4,523,296 A 6/1985 Healy, Jr.
4,560,222 A 12/1985 Dambach
4,571,014 A 2/1986 Robin et al.
4,607,899 A * 8/1986 Romine et al. ..... 439/512
4,664,458 A 5/1987 Worth
4,681,549 A 7/1987 Peterson
4,717,360 A 1/1988 Czaja
4,762,500 A 8/1988 Dola et al.
4,776,803 A 10/1988 Pretchel et al.
4,815,987 A 3/1989 Kawano et al.
4,846,727 A 7/1989 Glover et al.
4,850,887 A 7/1989 Sugawara
4,867,713 A 9/1989 Ozu et al.
4,898,539 A 2/1990 Glover et al.
4,900,271 A 2/1990 Colleran et al.
4,907,990 A 3/1990 Bertho et al.
4,913,664 A 4/1990 Dixon et al.
4,917,616 A 4/1990 Demler, Jr.
4,932,888 A 6/1990 Senor
4,954,093 A * 9/1990 Nadin ..... 439/188
4,973,271 A 11/1990 Ishizuka et al.
4,975,066 A 12/1990 Suchesku et al.
4,975,069 A 12/1990 Fedder et al.
4,997,390 A 3/1991 Scholz et al.
5,004,426 A 4/1991 Barnett
5,046,960 A 9/1991 Fedder
5,055,054 A 10/1991 Doutrich
5,065,282 A 11/1991 Polonio
5,066,236 A 11/1991 Broeksteeg
5,077,893 A 1/1992 Mosquera et al.
5,094,623 A 3/1992 Scharf et al.
5,098,311 A 3/1992 Roath et al.
5,104,341 A 4/1992 Gilissen et al.
5,127,839 A 7/1992 Korsunsky et al.
5,141,455 A 8/1992 Ponn
5,161,987 A 11/1992 Sinisi
5,163,337 A 11/1992 Herron et al.
5,163,849 A 11/1992 Fogg et al.
5,167,528 A 12/1992 Nishiyama et al.
5,174,770 A 12/1992 Sasaki et al.
5,181,855 A 1/1993 Mosquera et al.
5,197,893 A 3/1993 Morlion et al.
5,228,864 A 7/1993 Fusselman et al.
5,238,414 A 8/1993 Yaegashi et al.
5,254,012 A 10/1993 Wang
5,257,941 A 11/1993 Lwee et al.
5,274,918 A 1/1994 Reed
5,277,624 A 1/1994 Champion et al.
5,286,212 A 2/1994 Broeksteeg
5,288,949 A 2/1994 Crafts
5,302,135 A 4/1994 Lee
5,330,371 A 7/1994 Andrews
5,342,211 A 8/1994 Broeksteeg
5,356,300 A 10/1994 Costello et al.
5,356,301 A 10/1994 Champion et al.
5,357,050 A 10/1994 Baran et al.
5,382,168 A 1/1995 Azuma et al.
5,387,111 A 2/1995 DeSantis et al.
5,395,250 A 3/1995 Englert, Jr. et al.
5,399,104 A 3/1995 Middlehurst et al.
5,429,520 A 7/1995 Morlion et al.
5,431,578 A 7/1995 Wayne
5,475,922 A 12/1995 Tamura et al.
5,518,422 A 5/1996 Zell et al.
5,522,727 A 6/1996 Saito et al.
5,522,738 A 6/1996 Lace
5,558,542 A 9/1996 O'Sullivan et al.
5,564,949 A 10/1996 Wellinsky
5,575,688 A 11/1996 Crane, Jr.
5,586,908 A 12/1996 Lorrain
5,586,912 A 12/1996 Eslampour et al.
5,586,914 A 12/1996 Foster, Jr. et al.
5,590,463 A 1/1997 Feldman et al.
5,609,502 A 3/1997 Thumma
5,620,340 A 4/1997 Andrews
5,626,492 A * 5/1997 Onizuka et al. ..... 439/512
5,634,821 A 6/1997 Crane, Jr.
5,637,019 A 6/1997 Crane, Jr. et al.
5,664,968 A 9/1997 Mickievicz
5,668,408 A 9/1997 Nicholson
5,672,064 A 9/1997 Provencher et al.
5,697,799 A 12/1997 Consoli et al.
5,713,746 A 2/1998 Olson et al.
5,713,767 A 2/1998 Hanson et al.
5,730,609 A 3/1998 Harwath
5,741,144 A 4/1998 Elco et al.
5,741,161 A 4/1998 Cahaly et al.
5,766,023 A 6/1998 Noschese et al.
5,775,947 A 7/1998 Suzuki et al.
5,782,656 A 7/1998 Zell et al.
5,795,191 A 8/1998 Preputnick et al.
5,803,768 A 9/1998 Zell et al.
5,817,973 A 10/1998 Elco et al.
5,820,392 A 10/1998 Lin et al.
5,833,475 A 11/1998 Mitra
5,853,797 A 12/1998 Fuchs et al.
5,860,816 A 1/1999 Provencher et al.
5,871,362 A 2/1999 Campbell et al.
5,876,222 A 3/1999 Gardner et al.
5,882,227 A 3/1999 Neidich
5,893,761 A 4/1999 Loungeville
5,902,136 A 5/1999 Lemke et al.
5,904,581 A 5/1999 Pope et al.
5,908,333 A 6/1999 Perino et al.
5,921,810 A * 7/1999 Murakoshi ..... 439/510
5,938,479 A 8/1999 Paulson et al.
5,961,355 A 10/1999 Morlion et al.
5,967,844 A 10/1999 Doutrich et al.
5,971,817 A 10/1999 Longueville
5,980,321 A 11/1999 Cohen et al.
5,984,690 A 11/1999 Riechelmann et al.
5,992,953 A 11/1999 Rabinovitz
5,993,259 A 11/1999 Stokoe et al.
6,007,376 A 12/1999 Shimizu
6,022,227 A 2/2000 Huang
6,027,345 A 2/2000 McHugh et al.
6,042,427 A 3/2000 Adriaenssens et al.
6,050,862 A 4/2000 Ishii
6,068,520 A 5/2000 Winings et al.
6,086,386 A 7/2000 Fjrlstad et al.
6,116,926 A 9/2000 Ortega et al.
6,116,965 A 9/2000 Arnett et al.
6,123,554 A 9/2000 Ortega et al.
6,125,535 A 10/2000 Chiou et al.
6,129,592 A 10/2000 Mickievicz et al.
6,139,336 A 10/2000 Olson
6,146,157 A 11/2000 Lenoir et al.
6,146,203 A 11/2000 Elco et al.
6,152,747 A 11/2000 McNamara
6,154,742 A 11/2000 Herriot
6,171,115 B1 1/2001 Mickievicz et al.
6,171,149 B1 1/2001 Van Zanten
6,179,663 B1 1/2001 Bradley et al.
6,190,213 B1 2/2001 Reichart et al.
6,210,227 B1 4/2001 Yamasaki et al.
6,212,755 B1 4/2001 Shimada et al.
6,219,913 B1 4/2001 Uchiyama
6,220,896 B1 4/2001 Bertoncini et al.
6,224,432 B1 5/2001 Billman
6,227,882 B1 5/2001 Ortega et al.
6,241,535 B1 6/2001 Lemke et al.
6,267,604 B1 7/2001 Mickievicz et al.

6,269,539 B1 8/2001 Takahashi et al.
6,273,759 B1 8/2001 Perino et al.
6,280,209 B1 8/2001 Bassler et al.
6,293,827 B1 9/2001 Stokoe et al.
6,299,483 B1 10/2001 Cohen et al.
6,299,484 B2 10/2001 Van Woensel et al.
6,302,711 B1 10/2001 Ito
6,319,075 B1 11/2001 Clark et al.
6,322,379 B1 11/2001 Ortega et al.
6,322,393 B1 11/2001 Doutrich et al.
6,328,602 B1 12/2001 Yamasaki et al.
6,338,635 B1 1/2002 Lee
6,343,955 B2 2/2002 Billman et al.
6,347,952 B1 2/2002 Hasegawa et al.
6,350,134 B1 2/2002 Fogg et al.
6,354,877 B1 3/2002 Shuey et al.
6,358,061 B1 3/2002 Regnier
6,361,366 B1 3/2002 Shuey et al.
6,363,607 B1 4/2002 Chen et al.
6,364,710 B1 4/2002 Billman et al.
6,371,773 B1 4/2002 Crofoot et al.
6,375,474 B1 4/2002 Harper et al.
6,375,478 B1 4/2002 Kikuchi
6,379,188 B1 4/2002 Cohen et al.
6,386,914 B1 5/2002 Collins et al.
6,390,826 B1 5/2002 Affolter et al.
6,409,543 B1 6/2002 Astbury, Jr. et al.
6,414,248 B1 7/2002 Sundstrom
6,420,778 B1 7/2002 Sinyansky
6,431,914 B1 8/2002 Billman
6,435,914 B1 8/2002 Billman
6,457,983 B1 10/2002 Bassler et al.
6,461,202 B2 10/2002 Kline
6,464,529 B1 10/2002 Jensen et al.
6,471,548 B2 10/2002 Bertoncini et al.
6,482,038 B2 11/2002 Olson
6,485,330 B1 11/2002 Doutrich
6,494,734 B1 12/2002 Shuey
6,503,103 B1 1/2003 Cohen et al.
6,506,076 B2 1/2003 Cohen et al.
6,506,081 B2 1/2003 Blanchfield et al.
6,520,803 B1 2/2003 Dunn
6,526,519 B1 2/2003 Cuthbert
6,527,587 B1 3/2003 Ortega et al.
6,537,086 B1 3/2003 Mac Mullin
6,537,087 B2 3/2003 McNamara et al.
6,537,111 B2 3/2003 Brammer et al.
6,540,522 B2 4/2003 Sipe
6,540,558 B1 4/2003 Paagman
6,540,559 B1 4/2003 Kemmick et al.
6,547,066 B2 4/2003 Koch
6,551,140 B2 4/2003 Billman et al.
6,554,640 B1 4/2003 Koike et al.
6,554,647 B1 4/2003 Cohen et al.
6,561,849 B2 5/2003 Naito et al.
6,565,388 B1 5/2003 Van Woesel et al.
6,572,409 B2 6/2003 Nitta et al.
6,572,410 B1 6/2003 Volstorf et al.
6,589,071 B1 7/2003 Lias et al.
6,592,381 B2 7/2003 Cohen et al.
6,607,402 B2 8/2003 Cohen et al.
6,609,933 B2 8/2003 Yamasaki
6,633,490 B2 10/2003 Centola et al.
6,641,411 B1 11/2003 Stoddard et al.
6,641,825 B2 11/2003 Scholz et al.
6,648,657 B1 11/2003 Korsunsky et al.
6,652,318 B1 11/2003 Winings et al.
6,655,966 B2 12/2003 Rothermel et al.
6,659,808 B2 12/2003 Billman et al.
6,672,886 B2 1/2004 Billman
6,672,907 B2 1/2004 Azuma
6,692,272 B2 2/2004 Lemke et al.
6,695,627 B2 2/2004 Ortega et al.
6,717,825 B2 4/2004 Volstorf
6,736,664 B2 5/2004 Ueda et al.
6,743,057 B2 6/2004 Davis et al.
6,746,278 B2 6/2004 Nelson et al.
6,749,439 B1 6/2004 Potter et al.
6,749,468 B2 6/2004 Avery
6,762,067 B1 7/2004 Quinnones et al.
6,764,341 B2 7/2004 Lappoehn
6,776,649 B2 8/2004 Pape et al.
6,786,771 B2 9/2004 Gailus
6,805,278 B1 10/2004 Olson et al.
6,808,399 B2 10/2004 Rothermel et al.
6,808,420 B2 10/2004 Whiteman, Jr. et al.
6,824,391 B2 11/2004 Mickievicz et al.
6,797,215 B2 12/2004 Avery et al.
6,835,072 B2 12/2004 Simons et al.
6,843,679 B2 1/2005 Kuo et al.
6,843,686 B2 1/2005 Ohnishi et al.
6,848,944 B2 2/2005 Evans
6,851,974 B2 2/2005 Doutrich
6,851,980 B2 2/2005 Nelson et al.
6,869,292 B2 3/2005 Johnescu et al.
6,872,085 B1 3/2005 Cohen et al.
6,884,117 B2 4/2005 Korsunsky et al.
6,890,214 B2 5/2005 Brown et al.
6,893,300 B2 5/2005 Zhou et al.
6,893,686 B2 5/2005 Egan
6,899,566 B2 5/2005 Kline et al.
6,902,411 B2 6/2005 Kubo
6,913,490 B2 7/2005 Whiteman, Jr. et al.
6,918,776 B2 7/2005 Spink, Jr.
6,918,789 B2 7/2005 Lang et al.
6,932,649 B1 8/2005 Rothermel et al.
6,939,173 B1 9/2005 Elco et al.
6,945,796 B2 9/2005 Bassler et al.
6,951,466 B2 10/2005 Sandoval et al.
6,953,351 B2 10/2005 Fromm et al.
6,960,103 B2 11/2005 Tokunaga
6,969,280 B2 11/2005 Chien et al.
6,976,886 B2 12/2005 Winnings et al.
6,979,215 B2 12/2005 Avery et al.
6,981,883 B2 1/2006 Raistrcik et al.
6,994,569 B2 2/2006 Minich et al.
7,001,188 B2 2/2006 Kobayashi
7,021,975 B2 4/2006 Lappohn
7,040,901 B2 5/2006 Benham et al.
7,044,794 B2 5/2006 Consoli et al.
7,090,501 B1 8/2006 Scherer et al.
7,094,102 B2 8/2006 Cohen et al.
7,097,506 B2 8/2006 Nakada
7,101,191 B2 9/2006 Benham
7,108,556 B2 9/2006 Cohen et al.
7,114,964 B2 10/2006 Winings et al.
7,118,391 B2 10/2006 Minich et al.
7,131,870 B2 11/2006 Whiteman, Jr. et al.
7,137,832 B2 11/2006 Mongold et al.
7,139,176 B2 11/2006 Taniguchi et al.
7,153,162 B2 12/2006 Mizumura et al.
7,172,461 B2 2/2007 Davis et al.
7,175,446 B2 2/2007 Bright et al.
7,179,108 B2 2/2007 Goodman et al.
7,186,123 B2 3/2007 Lemke et al.
7,207,807 B2 4/2007 Fogg
7,207,836 B2 4/2007 Tsai
7,241,168 B2 7/2007 Sakurai et al.
7,247,050 B1 7/2007 Minich
7,278,856 B2 10/2007 Minich
7,281,950 B2 10/2007 Belopolsky
7,285,018 B2 10/2007 Kenny et al.
7,310,875 B2 12/2007 Evans
7,331,802 B2 2/2008 Rothermel et al.
7,331,830 B2 2/2008 Minich
7,396,259 B2 7/2008 Marshall
7,431,616 B2 10/2008 Minich
7,462,924 B2 12/2008 Shuey
7,497,736 B2 3/2009 Minich et al.
7,524,209 B2 4/2009 Hull et al.
7,534,142 B2 5/2009 Avery et al.
7,811,100 B2 10/2010 Stoner
2004/0157477 A1 8/2004 Johnson et al.
2004/0224559 A1 11/2004 Nelson et al.
2005/0170700 A1 8/2005 Shuey et al.
2005/0196987 A1 9/2005 Shuey et al.
2005/0227552 A1 10/2005 Yamashita et al.
2006/0073709 A1 4/2006 Reid

| | | | |
|---|---|---|---|
| 2006/0192274 | A1 | 8/2006 | Lee et al. |
| 2006/0228912 | A1 | 10/2006 | Morlion et al. |
| 2006/0232301 | A1 | 10/2006 | Morlion et al. |
| 2008/0176453 | A1 | 7/2008 | Minich et al. |
| 2009/0011641 | A1 | 1/2009 | Cohen et al. |
| 2009/0017652 | A1 | 1/2009 | Stoner |
| 2009/0017682 | A1 | 1/2009 | Amleshi et al. |
| 2009/0303689 | A1 | 12/2009 | Chang |

FOREIGN PATENT DOCUMENTS

| | | |
|---|---|---|
| EP | 0 554 821 | 8/1993 |
| EP | 0635910 | 1/1995 |
| EP | 0 932 226 | 7/1999 |
| EP | 0891016 | 10/2002 |
| EP | 1148587 | 4/2005 |
| EP | 1 635 429 | 3/2006 |
| EP | 1 933 422 | 6/2008 |
| JP | 2284372 | 11/1990 |
| JP | 03266383 | 11/1991 |
| JP | 06-236788 | 8/1994 |
| JP | 07-114958 | 5/1995 |
| JP | 11-185886 | 7/1999 |
| JP | 2000-003743 | 1/2000 |
| JP | 2000-003744 | 1/2000 |
| JP | 2000-003745 | 1/2000 |
| JP | 2000-003746 | 1/2000 |
| JP | 2004-103527 | 4/2004 |
| WO | WO 90/16093 | 12/1990 |
| WO | WO 01/29931 | 4/2001 |
| WO | WO 01/39332 | 5/2001 |
| WO | WO 02/101882 | 12/2002 |
| WO | WO 2006/031296 | 3/2006 |
| WO | WO 2006/105535 | 10/2006 |

OTHER PUBLICATIONS

Airmax VS®, "High Speed Connector System", FCI, www.fciconnect.com, 2004, 16 pages.

Amp Incorporated, "Z-Pack 2mm HM Connector, 2mm Centerline, Eight-Row, Right-Angle Applications", ACD-AMP Circuits and Design, Electrical Performance Report, Sep. 1998, 59 pages.

AMP Incorporated, "AMP Z-Pack 2mm HM Interconnection System", © 1992 and © 1994, AMP Incorporated, 6 pages.

Tyco Electronics, "AMP Z-Pack HM-Zd Performance at Gigabit Speeds", Tyco Electronics Circuit and Design, May 4, 2001, 32 pages.

Amphenol TCS (ATCS), "Backplane Connectors", http://www.amphenol-tcs.com/products/connectors/backplane/index.html, Jun. 19, 2008, 3 pages.

Amphenol TCS (ATCS), "Ventura® High Performance, Highest Density Available", http://www.amphenol-tcs.com/products/connectors/backplane/ventura.index.html, Jun. 19, 2008, 2 pages.

Amphenol TCS (ATCS), "VHDM Connector", http://www.teradyne.com/prods/tcs/products/connectors/backplane/vhdm/index/index.html, Jan. 31, 2006, 2 pages.

Amphenol TCS (ATCS), "HDM® Stacker Signal Integrity", http://www.teradyne.com/prods/tcs/products/connectors/mezzanine/hdm_stacker/signintegrity.html, Feb. 2, 2006, 3 pages.

*Amphenol TCS (ATCS)*, "*XCede® Connector*", http://www.amphenol-tcs.com/products/connectors/backplane/xcede/index.html, 5 pages, Jun. 19, 2008, 5 pages.

Amphenol TCS(ATCS), "VHDM L-Series Connector", http://www.teradyne.com/prods/tcs/products/connectors/backplane/vhdm_1-series/index.html, Jan. 31, 2006, 4 pages.

Backplane Products Overview Page, http://www.molex.com/cgi-bin/bv/molex/super_family/super_family.jsp?BV_Session ID=@, 2005-2006 © Molex, 4 pages.

Communications, Data, Consumer Division Mezzanine High-Speed High-Density Connectors GIG-ARRAY® and MEG-ARRAY® electrical Performance Data, Jun. 5, 2008, 10 pages. FCI Corporation.

DesignCon, "Interconnect Design Optimization and Characterization for Advanced High Speed Backplane Channel Links", Jan. 2009, 38 pages.

FCI's Airmax VS Connector System Honored at Design.con, 2005, Heilind Electrnoics, Inc., http://www.heilind.com/products/fci/airmax-vs-design.asp, 1 page.

Framatome Connector Specification, "Loading Pattern Reviews", May 10, 1999, 1 page.

Fusi, M.A. et al., "Differential Signal Transmission through Backplanes and Connectors", *Electronic Packaging and Production*, Mar. 1996, 27-31.

GIG-ARRAY ® High Speed Mezzanine Connectors 15-40 mm Board to Board, Jun. 5, 2006, 1 page.

Gig-Array® Connector System, Board to Board Connectors, 2005, 4 pages.

Goel, R.P. et al., "AMP Z-Pack Interconnect System", 1990, AMP Incorporated, 9 pages.

HDM Separable Interface Detail, Molex®, Feb. 17, 1993, 3 pages.

HDM/HDM *plus*, 2mm Backplane Interconnection System, Teradyne Connection Systems, © 1993, 22 pages.

HDM® HDM Plus® Connectors, http://www.teradyne.com/prods/tcs/products/connectors/backplane/hdm/index.html, 2006, 1 page.

Honda Connectors, Honda High-Speed Backplane Connector NSP Series, Honda Tsuschin Kogyo Co. Ltd. Development Engineering Division, Tokyo Japan, Feb. 7, 2003, 25 pages.

Hult, B., "FCI's Problem Solving Approach Changes Market, The FCI Electronics AirMax VS®", ConnectorSupplier.com, Http://www.connectorsupplier.com/tech_updates_FCI-Airmax_archive.htm, 2006, 4 pages.

Lucent Technologies' Bell Labs and FCI Demonstrate 25gb/S Data Transmission over Electrical Backplane Connectors, Feb. 1, 2005, http://www.lucent.com/press/0205/050201.bla.html, 4 pages.

Metral® 2mm High-Speed Connectors, 1000, 2000, 3000 Series, Electrical Performance Data for Differential Applications, FCI Framatome Group, 2 pages.

*Metral*™, "Speed & Density Extensions", *FCI*, Jun. 3, 1999, 25 pages.

Millipacs Connector, "Millipacs 5+2R STR HDR Conn Type A", Type A Specification, Dec. 14, 2004,1 page.

Molex Incorporated Drawings, 1.0 HDMI Right Angle Header Assembly (19 PIN) Lead Free, Jul. 20, 2004, 1 page.

Molex, Features and Specifications, www.molex.com/link/Impact.html, May 2008, 5 pages.

Molex, GbXI-Trac™ Backplane Connector System, www.molex.com/cgi-bin, 2007, 2 pages.

Molex, High Definition Multimedia Interface (HDMI), www.molex.com, Jun. 19, 2008, 2 pages.

Nadolny, J. et al., "Optimizing Connector Selection for Gigabit Signal Speeds", ECN™, Sep. 1, 2000, http://www.ecnmag.com/article/CA45245, 2 pages.

NSP, Honda The World Famous Connectors, http://www.honda-connectors.co.jp, Feb. 3, 2003, 6 pages, English Language Translation attached.

PCB-Mounted Receptacle Assemblies, 2.00 mm(0.079in) Centerlines, Right-Angle Solder-to-Board to-Board Signal Receptacle, *Metral*™, Berg Electronics, 10-6-10-7, 2 pages.

PCT Application No. PCT/US2009/035388, International Search Report, Filing date Feb. 27, 2009, Mailing date Oct. 12, 2009, 3 pages.

Samtec, E.I.P. Extended Life Product, Open Pin Field Array Seaf Series, 2005, www.samtec.com, 1 page.

Samtec, High Speed Characterization Report, SEAM-30-02.0-S-10-2 Mates with SEAF-30-05.0-S-10-2, Open Pin Field Array, 1.27 mm x 1.27mm Pitch 7mm Stack Height, 2005, www.samtec.com, 55 pages.

TB-2127 "Ventura™ Application Design", Revision, "General Release", Specification Revision Status-B. Hurisaker, Aug. 25, 2005, Amphenol Coproation 2006, 1-13.

Teradyne Connection Systems, Inc., "Daughtercard Hole Pattern: Signal Modules (10 & 25 positions) Connector Side", Customer Use Drawing No. C-163-5101-500, Rev. 04, Jun. 6, 2001, 1 page.

Tyco Electronics Engineering Drawing, Impact, 3 Pair 10 Column Signal Module, Mar. 25, 2008, 1 page.

Tyco Electronics Engineering Drawing, Impact, 3 Pair Header Unguided Open Assembly, Apr. 11, 2008, 1 page.

Tyco Electronics Z-Dok+ Connector, May 23, 2003, http://zdok.tycoelectronics.com, 15 pages.
Tyco Electronics, "Champ Z-Dok Connector System", Catalog # 1309281, Issued Jan. 2002, 3 pages.
Tyco Electronics, High Speed Backplane Interconnect Solutions, Feb. 7, 2003, 6 pages.
Tyco Electronics, Impact™ Connector Offered by Tyco Electronics, High Speed Backplane Connector System, Apr. 15, 2008, 1 page.
Tyco Electronics, Overview for High Density Backplane Connector (Z-Pack TinMan), 2005, 1 page.
Tyco Electronics, Overview for High Density Backplane Connectors (Impact™) Offered by Tyco Electronics, www.tycoelectronics.com/catalog, 2007, 2 pages.
Tyco Electronics, Two-Piece, High-Speed Connectors, www.tycoelectronics.com/catalog, 2007, 3 pages.
Tyco Electronics, Z-Dok and Connector, Tyco Electronics, Jun. 23, 2003, http://2dok.tyco.electronics.com, 15 pages.
Tyco Electronics, Z-Pack Slim UHD, http://www.zpackuhd.com, 2005, 8 pages.
Tyco Electronics, Z-Pack TinMan Product Portofolio Expanded to Include 6-Pair Module, 2005, 1 page.
Tyco Electronics/AMP, "Z-Dok and Z-Dok and Connectors", Application Specification # 114-13068, Aug. 30, 2005, Revision A, 16 pages.
VHDM Daughterboard Connectors Feature press-fit Terminations and a Non-Stubbing Seperable Interface, © Teradyne, Inc. Connections Systems Division, Oct. 8, 1997, 46 pages.
Teradyne, "VHDM, High-Speed Differential (VHDM HSD)", accessed Jan. 24, 2000 http://www.teradyne.com/prods/bps/vhdm/hsd.html, 6 pages.
U.S. Appl. No. 12/393,794, filed Feb. 26, 2009, Jonathan E. Buck.
International Patent Application No. PCT/US2010/059639: International Search Report dated Aug. 26, 2011, 3 pages.
Tyco Electronics, "High Speed Backplane Connectors, Multigig RT Connector Products," Catalog 1773095 Issued 4-05, 21 pages.
B.? Bandwidth and Rise Budgets, Module 1-8. Fiber Optic Telecommunications (E-XVI-2a), http://cord.org/step_online/st1-8/st18exvi2a.htm, 3 pages.
Backplane Products, www.molex.com, 2007, 3 pages.
U.S. Appl. No. 12/393,794: Non-Final Office Action, dated Aug. 19, 2010, 48 pages.
U.S. Appl. No. 12/393,794: Response to Non-Final Office Action dated Aug. 19, 2010, dated Dec. 20, 2010, 10 pages.
U.S. Appl. No. 12/393,794: Final Office Action dated Mar. 23, 2011, 17 pages.
U.S. Appl. No. 12/393,794: Response to Final Office Action dated Mar. 23, 2011 dated Sep. 23, 2011, 13 pages.

* cited by examiner

ELECTRICAL CONNECTOR SYSTEM HAVING A CONTINUOUS GROUND AT THE MATING INTERFACE THEREOF

CROSS-REFERENCE TO RELATED APPLICATIONS

This is a continuation application of U.S. patent application Ser. No. 12/129,086, filed May 29, 2008, which in turn claims benefit under 35 U.S.C. §119(e) of provisional U.S. patent application No. 60/949,541, filed Jul. 13, 2007, the disclosure of each of which is incorporated herein by reference in its entirety.

BACKGROUND

Electrical connectors provide signal connections between electronic devices using signal contacts. Often, undesirable interference, or crosstalk, exists between neighboring signal contacts. A common approach to reducing crosstalk includes interspersing ground contacts among the signal contacts. However, at certain frequencies, signals may tend to "jump" through or across ground contacts, which may contribute to mistransmission and signal errors that are detrimental to the operation of the circuits and the connector.

Frequency domain techniques may be helpful to measure and evaluate the signal loss and crosstalk characteristics of a connector system over a range of frequencies. Viewing crosstalk in the frequency domain shows the measure of crosstalk energy on individual frequencies of interest, e.g., the data rate and significant harmonics. It should be understood that spikes in frequency domain crosstalk are undesirable, as the spikes may indicate spurious voltages between grounds at particular frequencies.

One known approach for addressing such spikes is to fabricate connector leadframe housings from a carbon-impregnated plastic. Though such connectors are advertised to have low frequency domain crosstalk, even in a data-transfer-rate range of about 10-20 Gigabits/sec, the use of carbon-impregnated plastic makes such connectors relatively expensive. It would be desirable, therefore, if there were low-cost solutions that address the problem of spikes in frequency domain crosstalk.

SUMMARY

A connector interface may include an arrangement of blade-shaped contacts on a header connector, and a corresponding, complementary arrangement of receptacle contacts on a receptacle connector mating with the blades. The contacts may be positioned in the connectors in an arrangement of signal contacts and ground contacts. For example, a linear array of contacts may be arranged with a signal-ground-signal-ground arrangement, a signal-signal-ground arrangement, or a signal-signal-ground-ground arrangement. The contacts in each linear array may be positioned edge-to-edge and housed in a respective leadframe assembly. Each contact may be positioned broadside-to-broadside with a corresponding contact in an adjacent leadframe assembly. It should be understood, however, that the contacts within a leadframe assembly may be positioned broadside-to-broadside with each other, and positioned edge-to-edge with corresponding contacts in an adjacent leadframe assembly.

When the connectors are mated, a ground may be established between the connectors due to the mating of ground contacts from the respective connectors. Intermittent ground planes may be established at the contact mating surfaces where the broadsides of the receptacle ground contacts engage the broadsides of the header ground blades. Further, the receptacle ground contacts may be shaped to bridge together an array of header ground blades when the connectors are mated. Such bridging tends to establish a continuous ground along the array of mated ground contacts, thereby creating a more robust ground than in an otherwise identical connector. The continuous ground established along the array of mated ground contacts may extend along a direction that is perpendicular to the direction in which the contacts are arrayed in the leadframe assemblies.

In such a connector, frequency domain crosstalk tends to be lower than in an otherwise identical connector without such a continuous ground. Thus, spikes in the frequency domain crosstalk of a connector may be reduced by employing the bridging techniques disclosed herein. Also, electrical properties of a connector, such as signal integrity, for example, may be improved by establishing such a continuous ground.

DETAILED DESCRIPTION OF ILLUSTRATIVE EMBODIMENTS

Figure 1:
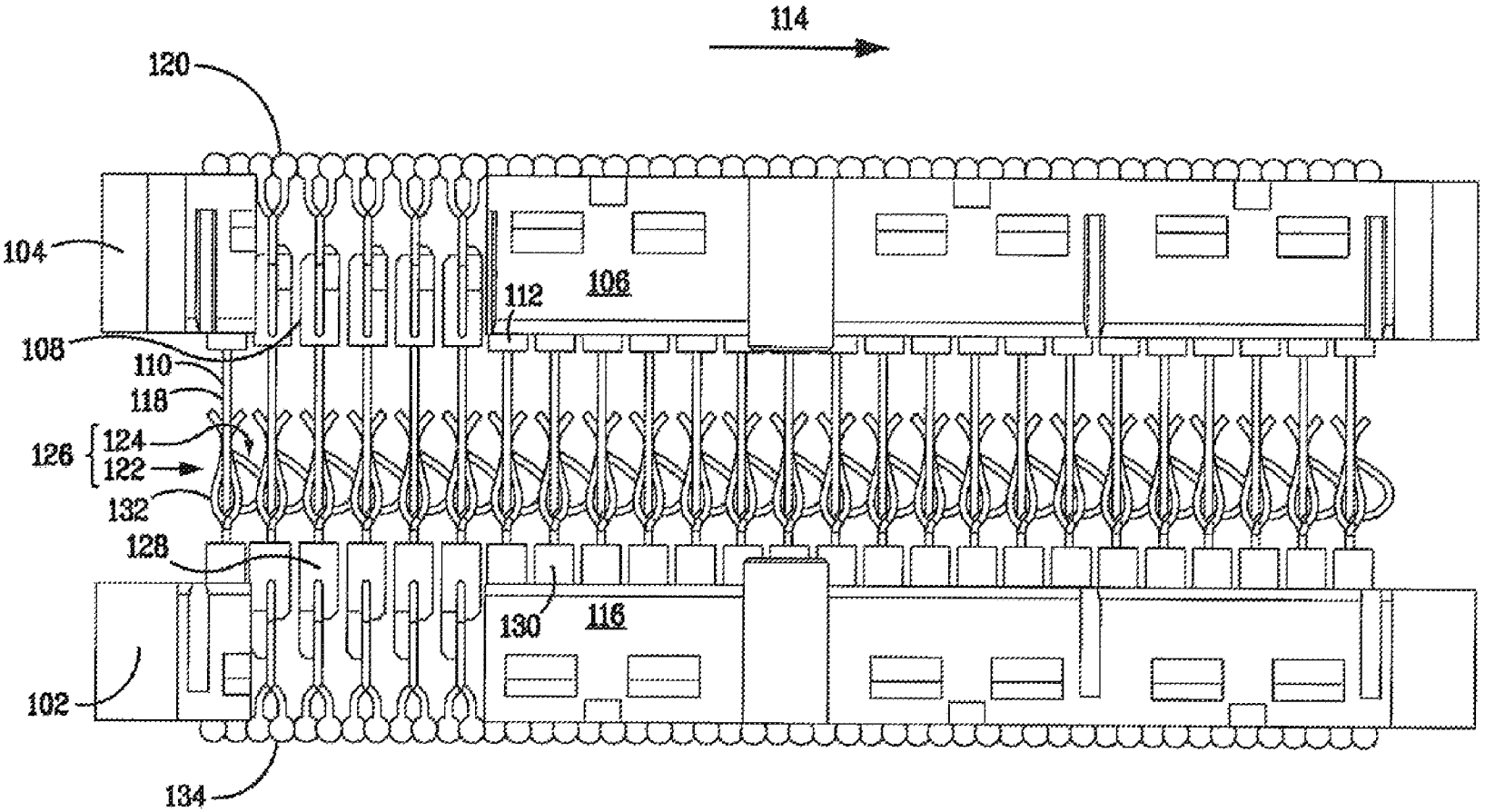
FIG. 1 depicts an electrical connector system having electrical contacts of a first connector mated to electrical contacts of a second connector.

FIG. 1 depicts a first electrical connector 102 mated to a second electrical connector 104, absent a top portion of each connector housing to show the mating interface. The mated electrical connectors 102, 104 may provide a connectable interface between one or more substrates, e.g., printed circuit boards. For example, the first connector 102 may be mounted to a first substrate, such as a printed circuit board, and the second connector 104 may be mounted to a second substrate, such as a printed circuit board. The connectors 102, 104 may be high-speed electrical connectors, i.e., connectors that operate at data transfer rates in excess of 1 Gigabit/sec, and typically at 10-20 Gigabits/sec or more. There is a well-known relationship between data transfer rate (also called "bit rate") and signal rise time. That is, rise time ≈0.35/bandwidth, where bandwidth is approximately equal to one-half of the data transfer rate.

The first connector 102 and the second connector 104 are shown as vertical connectors. That is, the first connector 102 and the second connector 104 each define mating planes that are generally parallel to their respective mounting planes. The embodiments depicted herein show the first connector 102 as a receptacle connector and the second connector 104 as a header connector. It should be understood that either the first or second electrical connectors 102, 104 could be a header connector or a receptacle connector, and both of the first and second electrical connectors 102, 104 can be right-angle or mezzanine connectors.

The header connector 104 may include a connector housing 106 and electrical contacts 110 extending therethrough. The electrical contacts 110 may be arranged in an arrays in the header connector 104. Each contact 110 may have a cross-section that defines two opposing edges and two opposing broadsides. For example, the contacts 110 may be positioned broadside-to-broadside in a linear array along a first direction 114 and edge-to-edge in a linear array in a second direction that is perpendicular to the first direction 114. FIG. 1 depicts a linear array of contacts 110 positioned broadside-to-broadside in the first direction 114, showing the edge of each electrical contact 110 in the linear array. Each contact 110 shown may be the first contact in an array of contacts positioned edge-to-edge, the array extending in the second direction (i.e., a direction going into the page of FIG. 1). The electrical contacts 110 may include both signal contacts and ground contacts that vary in size and arrangement. For example, along each array extending in the second direction or along each array extending in the first direction, the contacts may be in a signal-ground-signal arrangement, a ground-signal-ground-signal arrangement, or a ground-signal-signal arrangement.

The header connector 104 may include a plurality of insert molded leadframe assemblies (IMLAs) 108 positioned adjacent to one another in the header connector housing 106. Each IMLA 108 may include a leadframe housing 112 through which the contacts 110 at least partially extend. The leadframe housing 112 may be made of a dielectric material, such as plastic, for example. The electrical contacts 110 may be housed in each IMLA 108 in a linear array that extends in the first direction 114 or in the second direction that is perpendicular to the first direction. In FIG. 1, the electrical contacts arrayed in each IMLA 108 in the second direction (i.e., a direction going into the page of FIG. 1), where each contact 110 shown is one contact in the array of contacts positioned edge-to-edge in the IMLA 108. The broadsides of each contact 110 in each IMLA 108 may be adjacent to the broadside of another contact 110 from an adjacent IMLA 108, thereby creating the array of contacts shown positioned broadside-to-broadside along the first direction 114 in FIG. 1.

Each of the contacts 110 in the header connector may have a respective mating portion 118 and a respective mounting portion 120. The mounting portions 120 may be suitable for any surface-mount or through-mount application. The mounting portions 120 may be compliant tail ends, or they may include fusible mounting elements, such as solder balls. The mounting portions 120 of the contacts may form a ball grid array (BGA) and electrically connect with apertures on a substrate face. The mating portion 118 of each electrical contact 110 may be blade-shaped and may mate with a respective electrical contact (e.g., 122, 124) of the receptacle connector 102.

The receptacle connector 102 may each include a connector housing 116 and electrical contacts 126 extending therethrough. The electrical contacts 126 may be of varying shapes and sizes, as shown by example contacts 122 and 124. The electrical contacts 126 may be arranged in arrays in the receptacle connector 102. Each contact 126 may have a cross-section that defines two opposing edges and two opposing broadsides. For example, like contacts 110, contacts 126 may be positioned broadside-to-broadside in a linear array along a first direction 114 and edge-to-edge in a linear array in a second direction that is perpendicular to the first direction 114.

FIG. 1 depicts a linear array of receptacle contacts 122 positioned broadside-to-broadside in the first direction 114, showing the edge of each electrical contact 122. Each contact 122 shown may be the first contact in an array of contacts positioned edge-to-edge, the array extending in the second direction (i.e., a direction going into the page of FIG. 1). A second linear array of receptacle contacts 124 is partially shown, the contacts in the second linear array also positioned broadside-to-broadside in the first direction. The electrical contacts, collectively 126, may include both signal contacts and ground contacts that vary in size and arrangement. For example, for each array extending along each direction, the contacts 126 may be in a signal-ground-signal arrangement, a ground-signal-ground-signal arrangement, or a ground-signal-signal arrangement.

The receptacle connector 102 may include a plurality of insert molded leadframe assemblies (IMLAs) 128 positioned adjacent to one another in the receptacle connector housing 116. Each IMLA 128 may include a leadframe housing 130 through which the contacts 126 at least partially extend. The leadframe housing 130 may be made of a dielectric material, such as plastic, for example. The electrical contacts 126 may be housed in each IMLA 108 in a linear array that extends in the first direction 114 or second direction that is perpendicular to the first direction. In FIG. 1, the electrical contacts 126 are arrayed in each IMLA 108 in the second direction (i.e., a direction going into the page of FIG. 1), where each contact 122 shown is one contact in the array of contacts positioned edge-to-edge in each IMLA 108. Each of the contacts 124 partially shown are positioned edge-to-edge with an adjacent contact 122 in each of those arrays. The broadsides of each contact 126 in each IMLA 128 may be adjacent to the broadside of another contact 126 from an adjacent IMLA 128, thereby creating the array of contacts positioned broadside-to-broadside along the first direction 114.

Each of the contacts 126 in the receptacle connector may have a respective mating portion 132 and a respective mounting portion 134. The mounting portions 134 may be suitable for any surface-mount or through-mount application. The mountings portions 134 may be compliant tail ends, or they may include fusible mounting elements, such as solder balls. The mounting portions 134 of the contacts may form a ball grid array (BGA) and electrically connect with apertures on a substrate face.

The mating portion 132 of each of the receptacle contacts 126 may be any shape that may receive or otherwise engage with a complementary contact, such as the contacts 110 of the header connector 104. For example, the mating portion 132 of a receptacle contact 122 may include a receptacle for receiving a male contact. FIG. 1 depicts two possible receptacle contacts 122, 124 with varying shapes, each which may mate with a contact 110 of the header connector 104 that are blade-shaped.

Figure 2A:
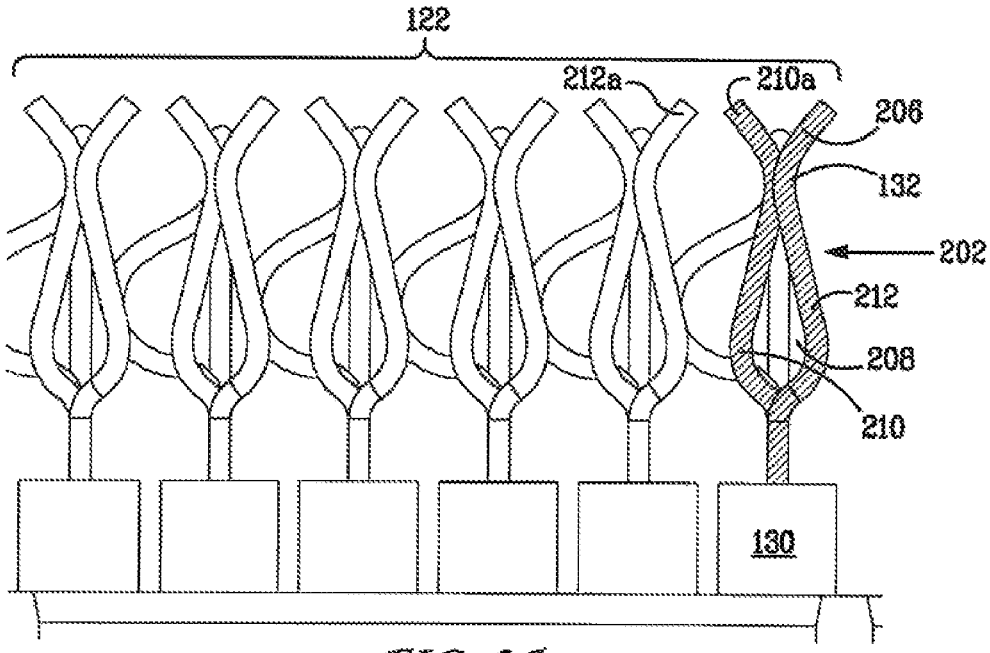
FIGS. 2A and 2B depict example electrical contacts of the first connector shown in FIG. 1.
Figure 2B:
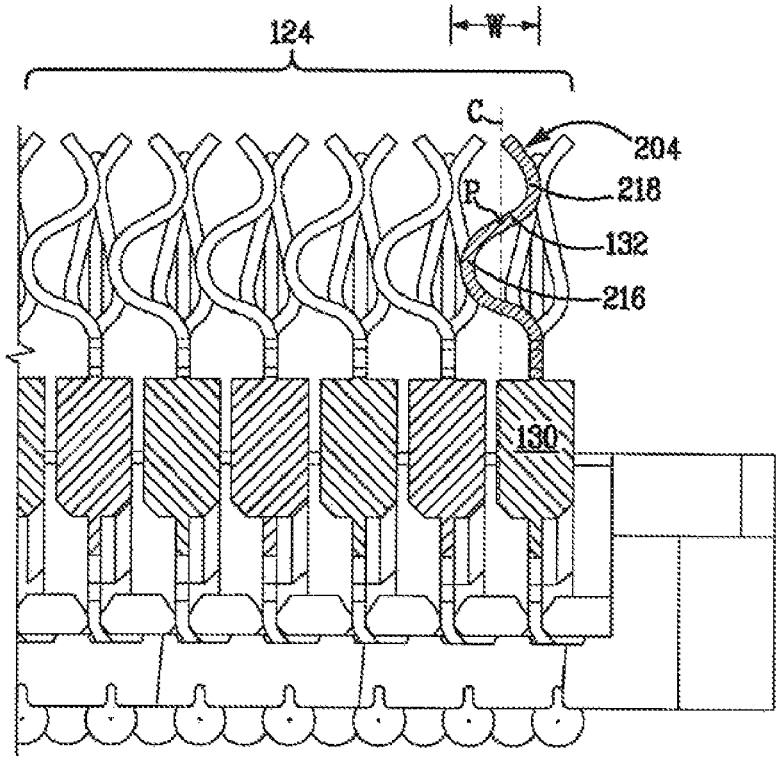

FIGS. 2A and 2B each depict an exploded view of the example receptacle contacts 122 and 124, respectively, of the receptacle connector 102 shown in FIG. 1. An example of each contact 202, 204 in each of FIGS. 2A and 2B is shaded for illustrative purposes. FIG. 2A depicts the mating portion 132 of the example receptacle contact 202, which includes a receptacle 208 for receiving a male contact, such as a blade-shaped contact 110 from header connector 104. The receptacle 208 of the contact 202 is depicted as a slot on the mating portion 132 of the receptacle contact 202 that includes at least two opposing tines 210, 212 that define the slot therebetween. The slot of the mating portion 132 may receive the blade-shaped mating portion 118 of the electrical contacts 110. The width of the slot (i.e., the distance between opposing tines)

may be smaller than the thickness of the blade-shaped mating portion 118. Thus, the opposing tines 210, 212 may exert a force on each side of a blade-shaped mating portion 118 of a contact 110 received therein, thereby retaining the mating portion 118 of the electrical contact 110 in the mating portion 132 of the electrical contact 202.

Upon insertion of the header contact 110, the opposing tines 210, 212 of the receptacle contact 206 may be separated such that a portion of the tines 210*a*, 212*a*, of adjacent contacts 206 make contact with each other. The mating receptacle and header contacts, 206, 110, may be ground contacts. Thus, the connection between a tine of a receptacle contact 206 with the tine of an adjacent receptacle contact, with header contacts 110 having a good electrical connection with the adjacent receptacle contacts, may establish a ground between the electrical contacts 122, 110.

FIG. 2B depicts a partial view of the cross-section of the receptacle connector 102, which shows a linear array of the electrical contacts 126 that extend in the first direction, which are only partially shown in FIG. 1. The mating portion 132 of the example contact 204 has a width W and includes a single tine. The receptacle contact 204 may be configured to make contact with an electrical contact 110 in the header connector 102. For example, the receptacle contact 204 may be generally s-shaped with a first portion 216 and a second portion 218.

The receptacle contact 204 may be configured to make contact with more than one electrical contact 110 in the header connector 102. The first portion 216 may make a point of contact with a header contact 110 and the second portion 218 may make another point of contact with an adjacent header contact 110. In FIG. 2B, the first portion 216 has a larger radius of curvature than the second portion. Thus, the first portion 216 extends further beyond a centerline C than the second portion 218, where the centerline C is a line drawn in the direction that the contact substantially extends from the leadframe housing 130, the line intersecting at the change in curvature point P on the S-shaped mating portion 132. As described in more detail below, the mating portion 132 may be any shape such that the receptacle contact 204 makes contact with more than one header contact 110 upon mating of the electrical connectors 102, 104. The mating receptacle and header contacts 204, 110 may be ground contacts. Thus, the mating of the receptacle contact 204 with more than one header contact 110 may thereby establish a ground between the header contacts 110.

Figure 3B:
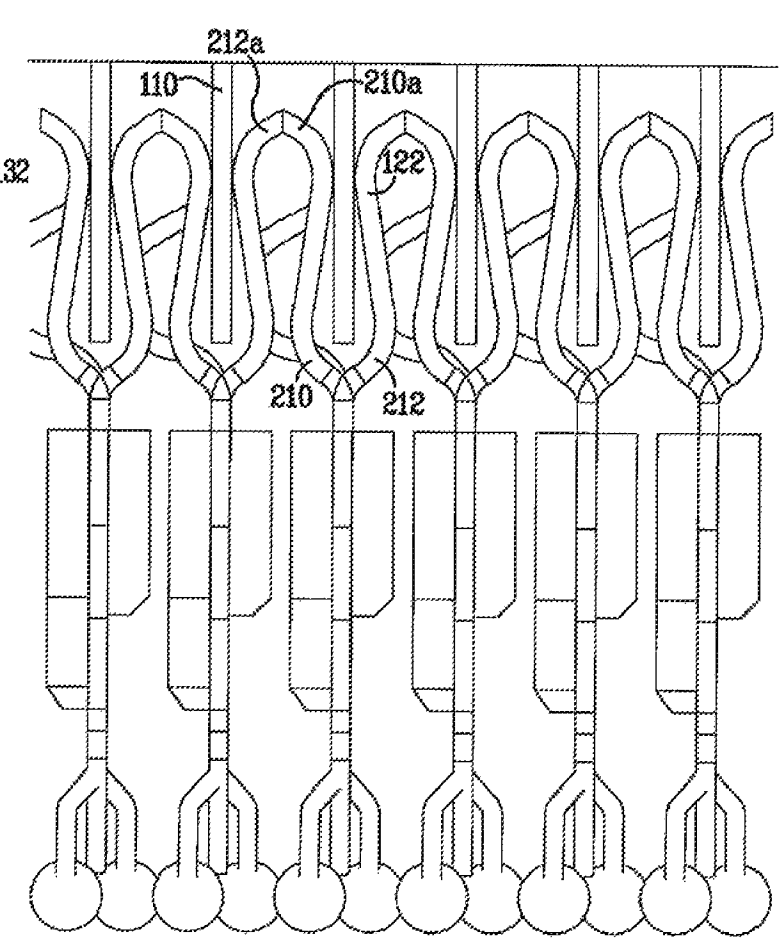
FIGS. 3A and 3B depict example mating interfaces, each having a continuous ground along an array of electrical contacts.
Figure 3A:
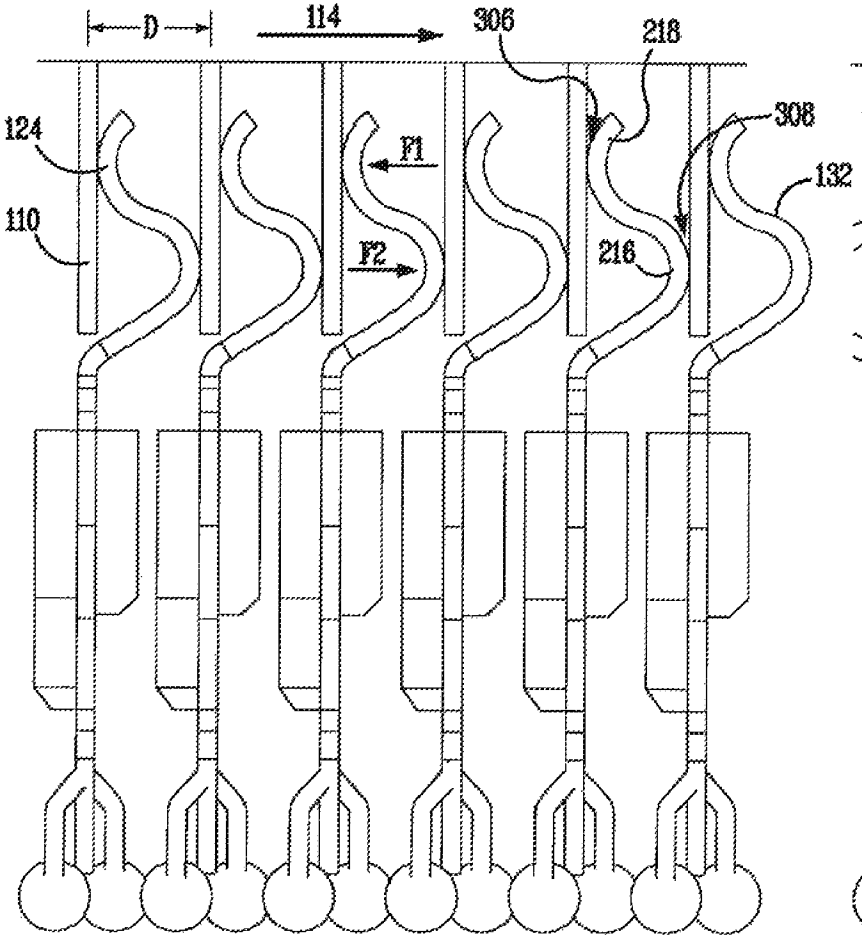

FIGS. 3A and 3B depict two example receptacle connector configurations such that a linear array of receptacle contacts engage a linear array of header contacts 110 and establish a continuous ground between the arrays. In FIG. 3A, the header contacts 110 are positioned broadside-to-broadside in an array and the receptacle contacts 124 are positioned broadside-to-broadside in an array, both arrays extending in the first direction 114. Each contact 110, 124 shown may be one contact in a respective array of contacts that extends in the second direction (i.e., into the page of FIG. 3A).

The receptacle contacts 124 may serve as bridging elements to bridge header contacts. For example, each of the receptacle contacts 124 may have a resilient mating portion 132 that is adapted to bridge together the array of ground contacts from the header connector. As the receptacle contacts 124 mate with adjacent header contacts 110, the receptacle contacts 124 may make points of contact with adjacent header contacts. Each receptacle contact 124 may make contact with more than one header contact 110. For example, the receptacle mating portions 132 may be generally S-shaped with a first curved portion 218 that makes a single point of contact 306 with a first header contact 110, and a second curved portion 216 that simultaneously makes a single point of contact 308 with a second header contact 110 that is adjacent to the first header contact 110. Thus, the receptacle contact 124 interconnects the first and second header contacts 110.

The mating portion 132 of the receptacle contact may have a variety of shapes and sizes. For example, the first curved portion 218 shown has a smaller radius of curvature than the radius of curvature of the second curved portion 216 shown. Upon insertion of a receptacle contact 124 between two adjacent header contacts 110, the first curved portion 218 may make an initial contact 306 with a first header contact 110. As the receptacle contact 124 is inserted further, the second curved portion 216 may make contact 308 with an adjacent, second header contact 110.

The receptacle contacts 124 may bridge together an array of header contacts 110. Each header contact 110 may be housed in a respective leadframe assembly. Thus, the receptacle contacts 124 may bridge together header contacts 110 across a plurality of leadframe assemblies. The receptacle contacts 124 and the header contacts 110 may be ground contacts. A common ground may be established between the header contacts 110 in the first direction, and the common ground may be established across contacts 110 housed in a plurality of leadframe assemblies. Such bridging establishes a common ground along the array of header contacts 110, which tends to reduce time domain frequency crosstalk.

The distance D between the header ground contacts 110 may be smaller than the width W of an unmated receptacle contact 124, as shown in FIG. 2B, that is to be inserted between adjacent header contacts 110. As the contacts 110, 124 are mated, the resilient mating portion 132 of the receptacle contact 124 may flex to accommodate the insertion of each receptacle contact 124 between adjacent header contacts 110. The insertion may result in a force normal F1, F2 to each of the receptacle/header contact mating surfaces. The opposing forces F1, F2 on each side of the receptacle contact 124 mating portion 132 may thereby establish a good electrical connection between contacts 124 and 110.

The receptacle contacts and header contacts are not limited to the sizes and shapes described herein. For example, the receptacle contact may be of any shape suitable for establishing a ground along a linear array of ground contacts. FIG. 3A depicts a single-tine receptacle contact 124 that is shaped to bridge together at least two blade-shaped header contacts 110 by making multiple points of contact between header contacts 110. Alternately, FIG. 3B depicts a dual-tine receptacle contact, such as contact 122, shaped to receive a blade-shaped contact 110 which creates a force that separates the tines 210, 212. The force may be sufficient to result in contact between adjacent tines 210*a* and 212*a* from different receptacle contacts, thus establishing a ground.

In FIG. 3B each contact 110, 122 shown may be one contact in a respective array of contacts that extends in the second direction (i.e., into the page of FIG. 3B). The opposing tines 210, 212 of the receptacle contact 206 may be separated as a result of the insertion of the header contact such that a portion of the tines 210*a*, 212*a*, of adjacent contacts 206 make contact with each other. The receptacle contacts 122 may bridge together the array of receptacle contacts 122 and header contacts 110. Each header contact 110 may be housed in a respective leadframe assembly. Thus, the receptacle contacts 122 may bridge together contacts 110, 122 across a plurality of leadframe assemblies. The receptacle contacts 122 and the header contacts 110 may be ground contacts. A common ground may be established between the contacts 110, 122 in the first direction, and the common ground may be established across contacts 110, 122 housed in a plurality of leadframe assemblies. Such bridging establishes a common ground along the array of receptacle and header contacts 122, 110, which may reduce time domain frequency crosstalk.

Figure 4B:
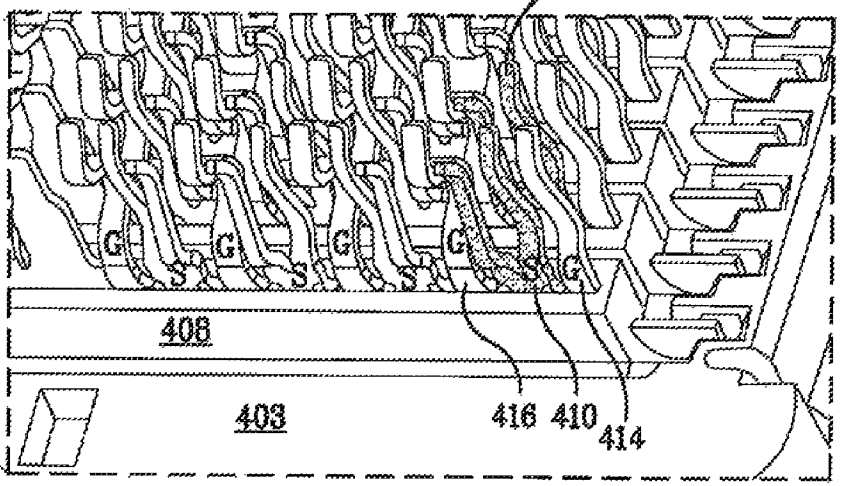
FIG. 4B depicts an exploded view of a section of the receptacle connector depicted in FIG. 4A.
Figure 4A:
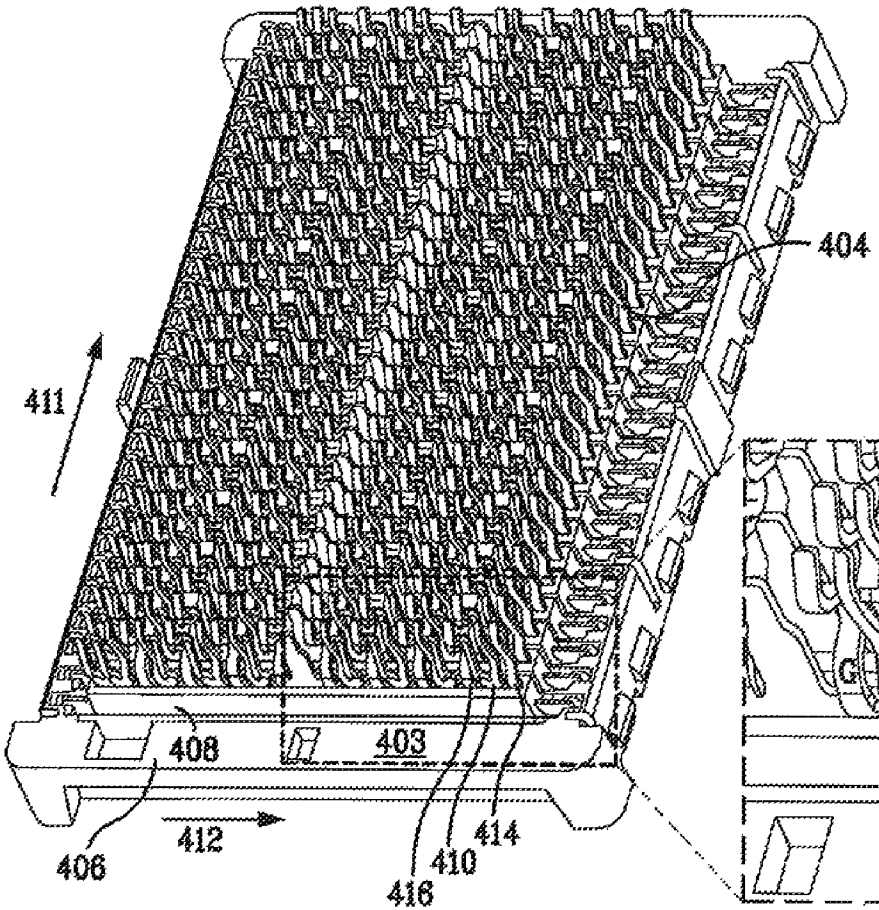
FIG. 4A depicts an isometric view of a receptacle connector absent a top portion of the connector housing.

FIG. 4A depicts an isometric view of a receptacle connector 402 with the top portion of the connector housing 403 removed. FIG. 4B depicts an exploded view of a section of contacts from the receptacle connector 402. The receptacle connector 402 may include a receptacle connector housing 403 which may be made of dielectric material, such as plastic, thermoplastic, or the like. The housing 403 may be manufactured by any technique, such as injection molding, for example.

The receptacle connector 402 may contain an array of electrically conductive contacts 404 that define a mating region. The electrical contacts 404 may be housed in insert molded leadframe assemblies (IMLAs) 408. Each IMLA 406 may include a leadframe housing 408 through which the contacts 404 at least partially extend. The leadframe housing 408 may be made of a dielectric material, such as plastic, for example. The IMLAs may be positioned adjacent to each other in a linear array that extends in direction 411 or 412. FIGS. 4A and 4B depict a linear array of IMLAs extending in the first direction, each IMLA housing an array of contacts positioned edge-to-edge. Thus, the broadsides of each contact 404 in each IMLA 406 may be adjacent to the broadside of another contact 404 from an adjacent IMLA 406, thereby creating a plurality of arrays of contacts positioned broadside-to-broadside along the first direction 411.

The electrical contacts 404 may include both signal contacts and ground contacts that vary in arrangement. For example, along each array that extends in the first or first direction, the contacts 404 may be in a signal-ground-signal arrangement, a ground-signal-ground-signal arrangement, or a ground-signal-signal arrangement. A plurality of differential signal pairs may be positioned adjacent to one another along the first direction or along the second direction, forming either broadside-coupled or edge-coupled differential signal pairs. FIGS. 4A and 4B depict a ground-signal-ground-signal arrangement positioned edge-to-edge along in arrays extending in the second direction with broadside-coupled differential signal pairs in arrays extending in the first direction. For example, from right to left in the first IMLA shown in FIG. 4B, 414 is a ground contact, 410 is a signal contact, 416 is a ground contact, and so on. Contact 412 may form a differential signal pair with contact 410. Contacts 410 and 412 are shaded for illustrative purposes.

The contacts in the receptacle connector 402 may be of varying shapes and sizes. FIGS. 4A and 4B show a different contact shape for each mating portion of contacts 414, 410, and 416. As shown, the mating portions may include one or more tine. For example, the mating portion may be a dual-beam receptacle contact interface such as the mating portion of contact 410, adapted to engage respective blade-shaped contacts from the header connector. As described herein, ground contact 416 is shaped such that contact may be made with more than one header contact 110 when the receptacle connector 402 is mated with a header connector. Thus, when the receptacle connector 402 is mated to a header connector, a continuous ground may be established along a linear array of ground contacts in a direction 411 that begins with ground contact 416. FIG. 4A depicts a plurality of linear arrays of ground contacts with the shape of ground contact 416. Thus, a plurality of continuous grounds may be established along the direction 411. Each of the ground contacts 404 in the linear array in the direction 411 are housed in respective IMLAs. Thus, the continuous grounds are established along the direction 411 between ground contacts 404 across a plurality of IMLAs 408. The contacts 404 are not limited to the sizes and shapes described herein for the establishment of a continuous ground. For example, the receptacle contact 416 may be of any shape suitable for establishing a ground along a linear array of complementary ground contacts.

Figure 5B:
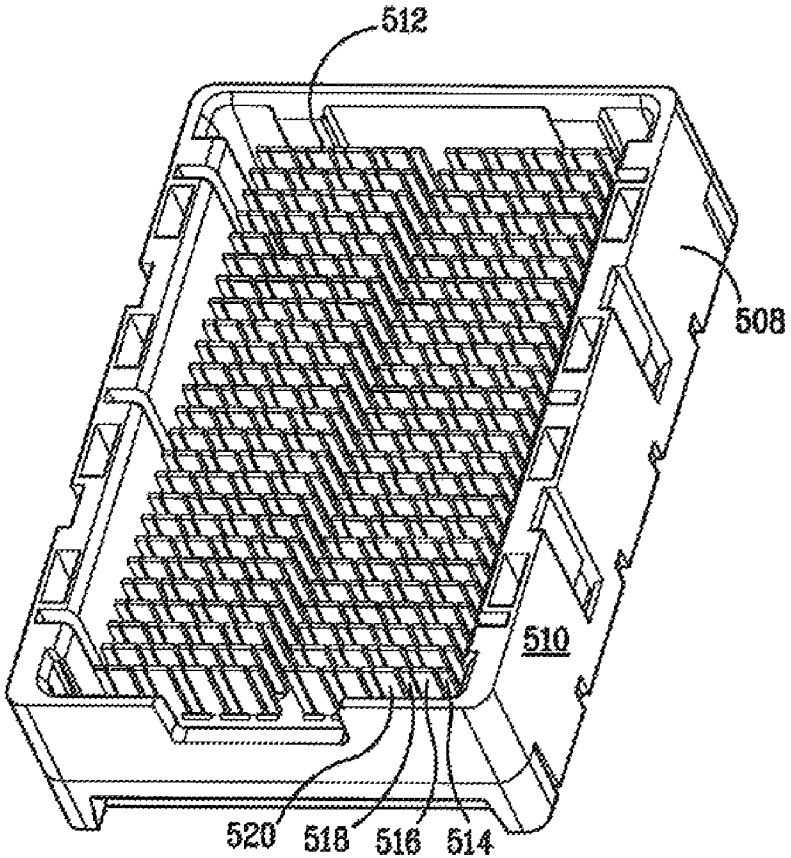
FIG. 5B depicts a header connector that is suitable for mating with the receptacle connector of FIG. 5A.
Figure 5A:
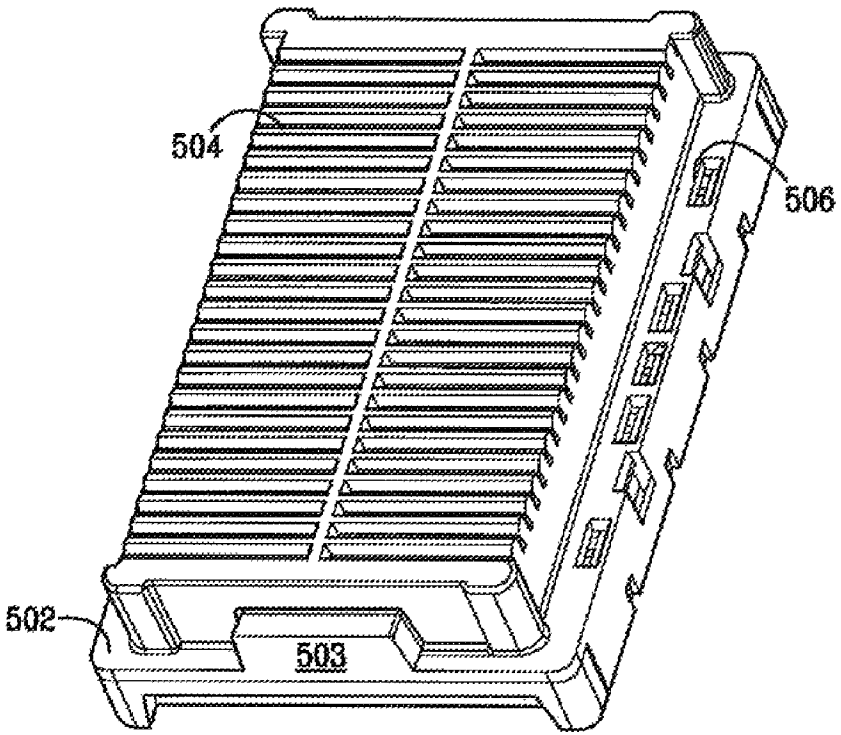
FIG. 5A depicts the receptacle connector of FIG. 3A with the entire connector housing.

FIG. 5A depicts a receptacle connector 502 that is the receptacle connector 402 of FIG. 4A with the connector housing 503 fully in tact. Disposed in each aperture 504 is an array of electrical contacts 404 positioned edge-to-edge in an IMLA 408, as described with respect to FIG. 4A. There are a plurality of latching mechanisms 506 formed in the connector housing 503 that are adapted to latch with complementary latching mechanisms formed in the housing of a complementary connector, such as the header connector 508 depicted in FIG. 5B.

FIG. 5B depicts the header connector 508 that may mate with the receptacle connector 502 of FIG. 5A. The header connector 508 may include a connector housing 510 and electrical contacts 512 extending therethrough. The electrical contacts 512 may be arranged in linear arrays and each contact 512 may have a cross-section that defines two opposing edges and two opposing broadsides.

The electrical contacts 512 may include both signal contacts and ground contacts that vary in size and arrangement. For example, along each array extending in the first or first direction, the contacts may be in a signal-ground-signal arrangement, a ground-signal-ground-signal arrangement, or a ground-signal-signal arrangement. As a complementary connector to the receptacle connector 502, the contacts in the header connector 508 are arranged in a ground-signal-ground-signal arrangement and are positioned edge-to-edge in an array extending in the second direction and broadside-to-broadside in an array extending in the first direction. For example, from right to left in the first array of contacts in the header connector 508 are ground contact 514, signal contact 516, ground contact 518, signal contact 520, and so on.

Each of the contacts 512 in the header connector 508 may have a respective mating portion that may be of varying shapes and sizes. For example, the ground contacts, such as example contact 514, are shown having a broadside that is less broad than the broadsides of the signal contacts, such as example signal contact 516. The mating end of each electrical contact 512 may be blade-shaped and may be adapted to mate with a respective electrical contact of the receptacle connector 502.

The header connector 508 may be mated to the receptacle connector 502 until the connector housing 510 of the header connector 508 abuts the connector housing 503 of the receptacle connector 502. The contact mating portions that are disposed in each aperture 504 in the receptacle connector 502 may mate with the contact mating portions of the header connector 508. As described herein, the ground contacts in the receptacle connector 502 may be shaped to bridge together a linear array of ground contacts 512 in the second connector when the connectors 502, 508 are mated. Thus, a ground may be established between the connectors 502, 508 by the mating of ground contacts 404, 512 from the respective connectors 502, 508. Such bridging tends to establish a continuous ground along a linear array of ground contacts, such as an array of header contacts extending in the first direction and starting with contact 518, which thereby creates a more robust ground.

Figure 6:
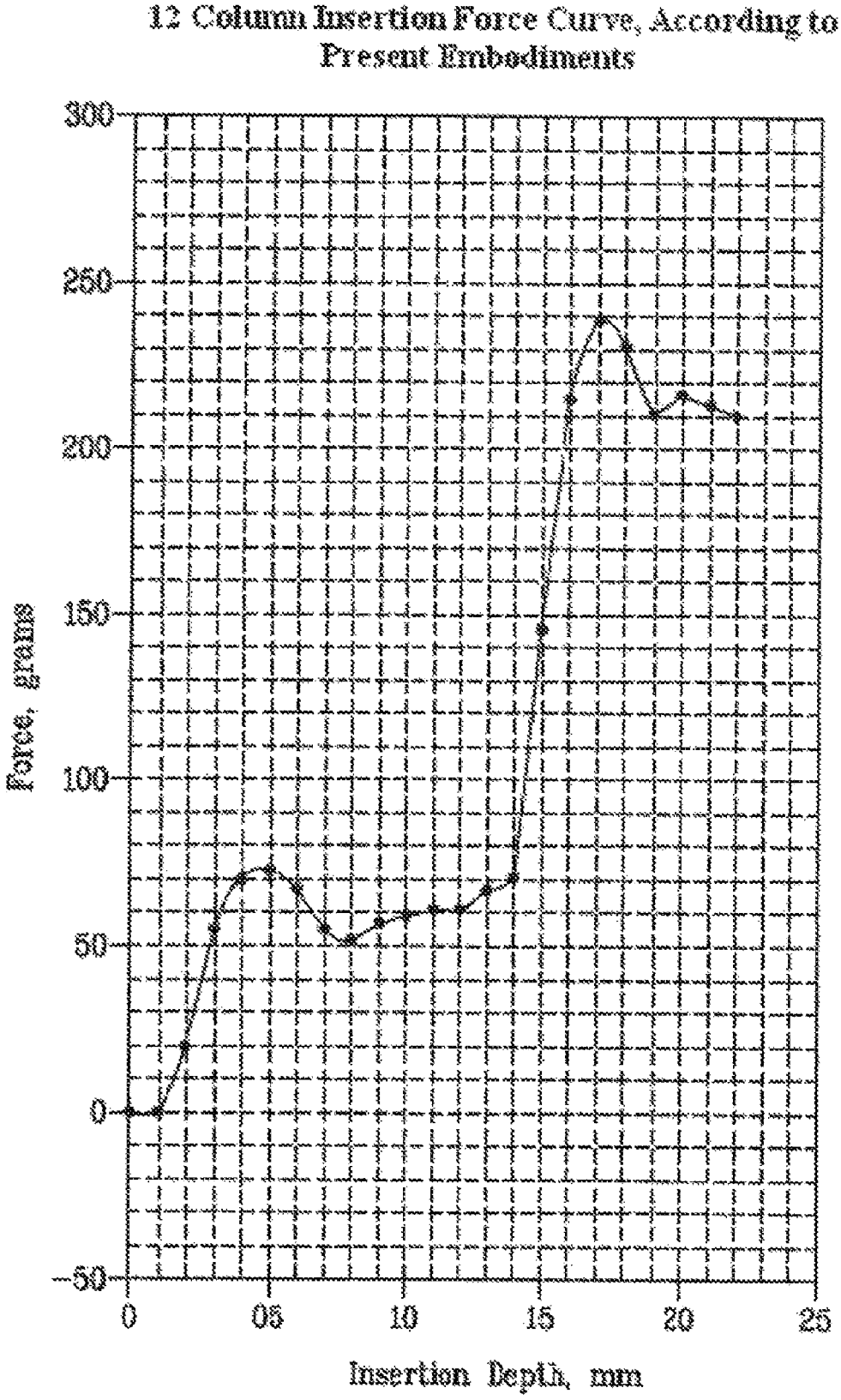
FIG. 6 provides a graphical representation of insertion force as a function of insertion depth.

FIG. 6 is a graphical representation of the insertion force that results when the receptacle contact is inserted between more than one header contact. Upon insertion of a receptacle contact 124 between two adjacent header contacts 110, a first portion of the receptacle contact 218 may make an initial contact with a first header contact 110. As the receptacle contact is inserted further, a first portion 216 may make contact with an adjacent, second header contact 110. The resilient mating portion 132 of the receptacle contact 124 may flex to accommodate the insertion of the receptacle contacts 124 between the header contacts 110, where the width of the receptacle contact 124 is greater than the distance between the header contacts 110.

The force may elongate the receptacle contact 124 and result in a force normal to each of the receptacle/header contact mating surfaces, such as at the points of contact 306, 308. The force exerted may retain the mating portion 132 of the receptacle contact 124 between the adjacent header contacts 110. Thus, a better electrical connection between the contacts 110, 124, as well as between the contacts 110, 122 may be made and sustained. As indicated, the deeper the insertion, the greater the resulting force. The increase in force may correspond to the insertion of the receptacle contact at the point where the first portion 216 of the receptacle contact 124 makes contact with the second header contact 110.

What is claimed:

1. An electrical connector system comprising:

an electrical connector carrying first and second leadframe assemblies, each of the first and second leadframe assemblies including first and second differential signal pairs and a ground contact disposed between the first and second differential signal pairs, and an electrically conductive bridging element that bridges the ground contacts of the first and second leadframe assemblies so as to define a continuous ground across the ground contacts of the first and second leadframe assemblies.

2. The electrical connector system of claim 1, wherein the continuous ground reduces crosstalk.

3. The electrical connector system of claim 1, wherein the ground contacts of the first and second leadframe assemblies comprise a respective mating portion and a respective mounting portion and the mounting portion is a compliant tail end.

4. The electrical connector system of claim 1, wherein the ground contacts of the first and second leadframe assemblies comprise a respective mating portion and a respective mounting portion, and the mounting portion is a fusible mounting element.

5. The electrical connector system of claim 1, wherein the electrically conductive bridging element is a receptacle contact that bridges together the first and second ground contacts.

6. The electrical connector system of claim 1, wherein the ground contacts of the first and second leadframe assemblies each define a mounting portion configured to engage a substrate, and a contact portion connected to the mounting portion, and the contact portions of the ground contacts of the first and second leadframe assemblies are bridged together by the electrically conductive bridging element.

7. The electrical connector system of claim 1, wherein the electrical connector is a first electrical connector, and the electrical connector system further comprises a second electrical connector that carries the electrically conductive bridging element.

8. The electrical connector system of claim 7, wherein the first and second leadframe assemblies are disposed in respective first and second parallel planes, and the electrically conductive bridging element is disposed in the second electrical connector along a third plane that is substantially coincident with the first plane.

9. The electrical connector system of claim 7, wherein the electrically conductive bridging elements is carried by a third leadframe assembly disposed in the second electrical connector.

10. An electrical connector system comprising:

a first plurality of electrical contacts arranged in a signal-signal-ground arrangement and arrayed along a first direction;

a second plurality of electrical contacts arranged in a signal-signal-ground arrangement and arrayed along a second direction that is spaced from the first direction;

a common ground connected between a first ground contact of the first plurality of electrical contacts and a second ground contact of the second plurality of electrical contacts;

a first electrical connector that carries the first and second pluralities of electrical contacts; and a second electrical connector that carries the common ground, wherein the common ground is connected between the first and second ground contacts when the first and second electrical connectors are mated.

11. The electrical connector system of claim 10, wherein the first plurality of contacts is disposed in a leadframe assembly.

12. The electrical connector system of claim 10, wherein the second plurality of contacts is disposed in a leadframe assembly.

13. The electrical connector system of claim 10, wherein the first and second pluralities of contacts are disposed in respective leadframe assemblies.

14. The electrical connector system of claim 10, wherein the first and second directions extend parallel to each other.

15. The electrical connector system of claim 10, wherein adjacent signal contacts of the first plurality of electrical contacts define differential pairs, and adjacent signal contacts of the second plurality of electrical contacts define differential pairs.

16. The electrical connector system of claim 10, wherein the common ground is elongate along a direction angularly offset with respect to the first and second directions.

17. The electrical connector system of claim 16, wherein the common ground extends along a direction perpendicular with respect to the first and second directions.

18. An electrical connector system comprising:

a first electrical connector carrying first and second arrays of electrical contacts, the first array of electrical contacts arranged in a signal-signal-ground arrangement, the electrical contacts of the first array each defining an edge and a broadside, wherein the electrical contacts of the first array are positioned edge-to-edge, the second array of electrical contacts arranged in a signal-signal-ground arrangement, the electrical contacts of the second array each defining an edge and a broadside, wherein the electrical contacts of the second array are positioned edge-to-edge, and the second array is spaced from the first array; and a second electrical connector carrying a ground contact that is aligned with the first array of electrical contacts when the first end second electrical connectors are mated, the ground contact having a contact portion that contacts a first broadside of a first ground contact of the first array of electrical contacts and contacts a second broadside of a second ground contact of the second array of electrical contacts when the first electrical connector is mated to the second electrical connector so as to create a common ground between the first and second ground contacts.

19. The electrical connector system of claim 18, wherein the common ground extends in a direction perpendicular to the direction in which the electrical contacts are arrayed in the first and second arrays.

* * * * *